United States Patent [19]

Krautkremer et al.

[11] 4,411,630

[45] Oct. 25, 1983

[54] WATER-JET DRIVE MECHANISM FOR THE DRIVING OF WATERCRAFT

[75] Inventors: Franz Krautkremer; Siegfried Lais, both of Spay, Fed. Rep. of Germany

[73] Assignee: Schottel-Werft, Josef Becker GmbH & Co KG., Spay, Fed. Rep. of Germany

[21] Appl. No.: 234,125

[22] Filed: Feb. 13, 1981

[30] Foreign Application Priority Data

Mar. 13, 1980 [DE] Fed. Rep. of Germany ..... 3009671

[51] Int. Cl.[3] ..... B63H 11/02

[52] U.S. Cl. ..... 440/42; 440/47; 114/151; 60/231

[58] Field of Search ..... 440/44, 45, 47, 46, 440/40–43; 60/221, 222, 232; 416/20 A, 20 R; 114/151; 239/265.23

[56] References Cited

U.S. PATENT DOCUMENTS

| | | | |
|---|---|---|---|
| 3,098,464 | 7/1963 | Holland | 440/46 |
| 3,233,833 | 2/1966 | Bertin et al. | 60/231 |
| 3,288,100 | 11/1966 | Cox et al. | 440/47 |
| 3,624,737 | 11/1971 | Keller | 440/47 |
| 3,943,876 | 3/1976 | Kiekhaefer | 440/47 |

FOREIGN PATENT DOCUMENTS

| | | | |
|---|---|---|---|
| 2757454 | 7/1979 | Fed. Rep. of Germany | 440/42 |

*Primary Examiner*—Trygve M. Blix
*Assistant Examiner*—Stephen P. Avila
*Attorney, Agent, or Firm*—Flynn, Thiel, Boutell & Tanis

[57] ABSTRACT

A water-jet drive mechanism for driving of watercraft and including an elbow located in the hull of the watercraft and containing a pump or the like by which water is sucked in at the bottom of the watercraft through a suction passage and is ejected downwardly through an ejector passage. A gas is supplied to the water jet at the ejector passage.

5 Claims, 3 Drawing Figures

WATER-JET DRIVE MECHANISM FOR THE DRIVING OF WATERCRAFT

FIELD OF THE INVENTION

The invention relates to a water-jet drive mechanism, for driving of watercraft and of the type including an elbow located in the hull of the watercraft and containing a pump by which water is sucked in at the bottom of the watercraft through a suction passage and is ejected downward through an ejector passage.

BACKGROUND OF THE INVENTION

Water-jet drive mechanisms of this type are known. They serve to drive or to drive and control ships. In the latter case, it is possible for the above-mentioned elbow to be pivotable about a substantially vertical axis. The pivot axis of the elbow and the axis of rotation of the pump may thereby be located coaxially or eccentrically to one another. The pump axis can also be installed inclined. (U.S. Pat. No. 3,098,464, German OS No. 2 757 454).

In the drive mechanisms of the mentioned and similar type, the water jet applies itself to (in effect sticks to) the bottom surface of the ship behind the elbow or pump and thereby entrains large amounts of water from the surroundings. This results in a loss of the thrust and a lowering of the boat.

The basic purpose of the invention is to avoid this disadvantage, namely to take care that the jet comes free better from the ship and thus carries out no or at least almost no damaging action.

The basic purpose of the invention is attained with a water-jet drive mechanism, wherein a gas is supplied to the water jet at the ejector passage. It is thereby particularly advantageous to develop the invention so as to provide a passageway which connects the ejector passage to the outside air and supplies such gas to the water jet. This construction of the invention has namely the advantage that, in the case of pivotable elbows, the air-supply output pivots with the ejector passage. This avoids having the air sucked in by the water pump or the like.

The invention achieves the following advantages. The ejecting angle of the water jet is maintained which reduces the friction on the hull of the ship; this results in an increase of the thrust. Furthermore it is achieved that water is not entrained from the surroundings. This results in a lesser lowering of the ship and a smaller wave formation.

BRIEF DESCRIPTION OF THE DRAWINGS

The invention is discussed in connection with FIGS. 1 to 3.

DETAILED DESCRIPTION

Figure 1:
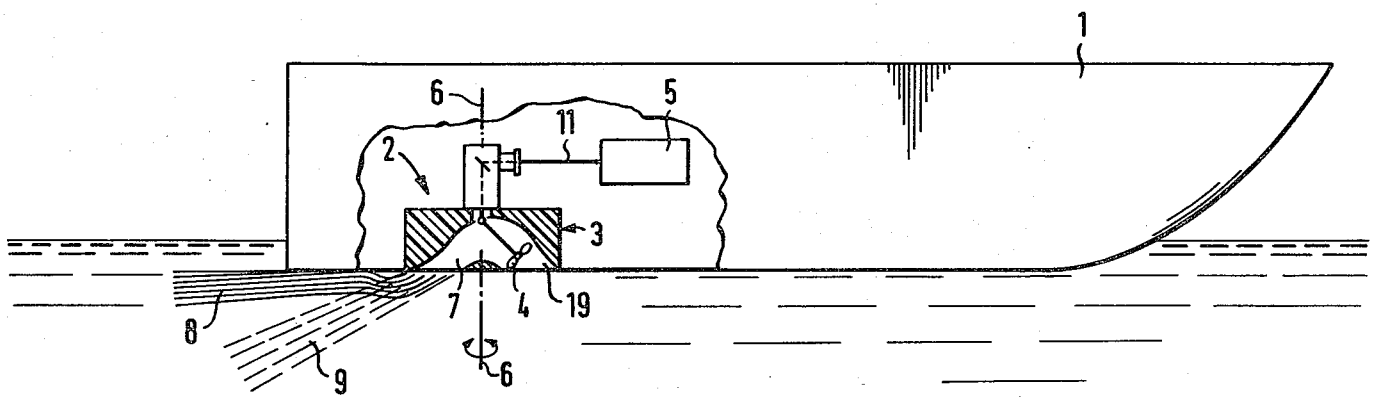
FIG. 1 schematically illustrates a watercraft with a jet and contrasts the condition of the jet with the invention respectively absent from, and applied to, the watercraft.

FIG. 1 schematically illustrates a watercraft 1 with a water-jet drive mechanism 2. Same consists substantially of an elbow 3, in which a propeller pump 4 is supported. The propeller pump is driven by a motor 5 through drive elements which will be described below. The elbow is pivotable about a pivot axis 6 and is supported drivably therefor. The propeller shaft which carries the propeller of the propeller pump 4 is inclined to the pivot axis. The ejector passage 7 of the elbow is directed inclined downwardly. The watercraft is driven by the ejected water jet and is controlled by pivoting the elbow. However, in the absence of the invention, the water jet is not angled downwardly, but instead the direction of the jet, as indicated at 8, lies along the hull of the ship, which results in the above-described disadvantages. With the invention, which is described in greater detail hereafter in connection with FIGS. 2 and 3, the water jet is directed at a downward inclination, as indicated at 9.

The water-jet drive mechanism will be referred to hereinafter more briefly as the drive mechanism.

Figure 2:
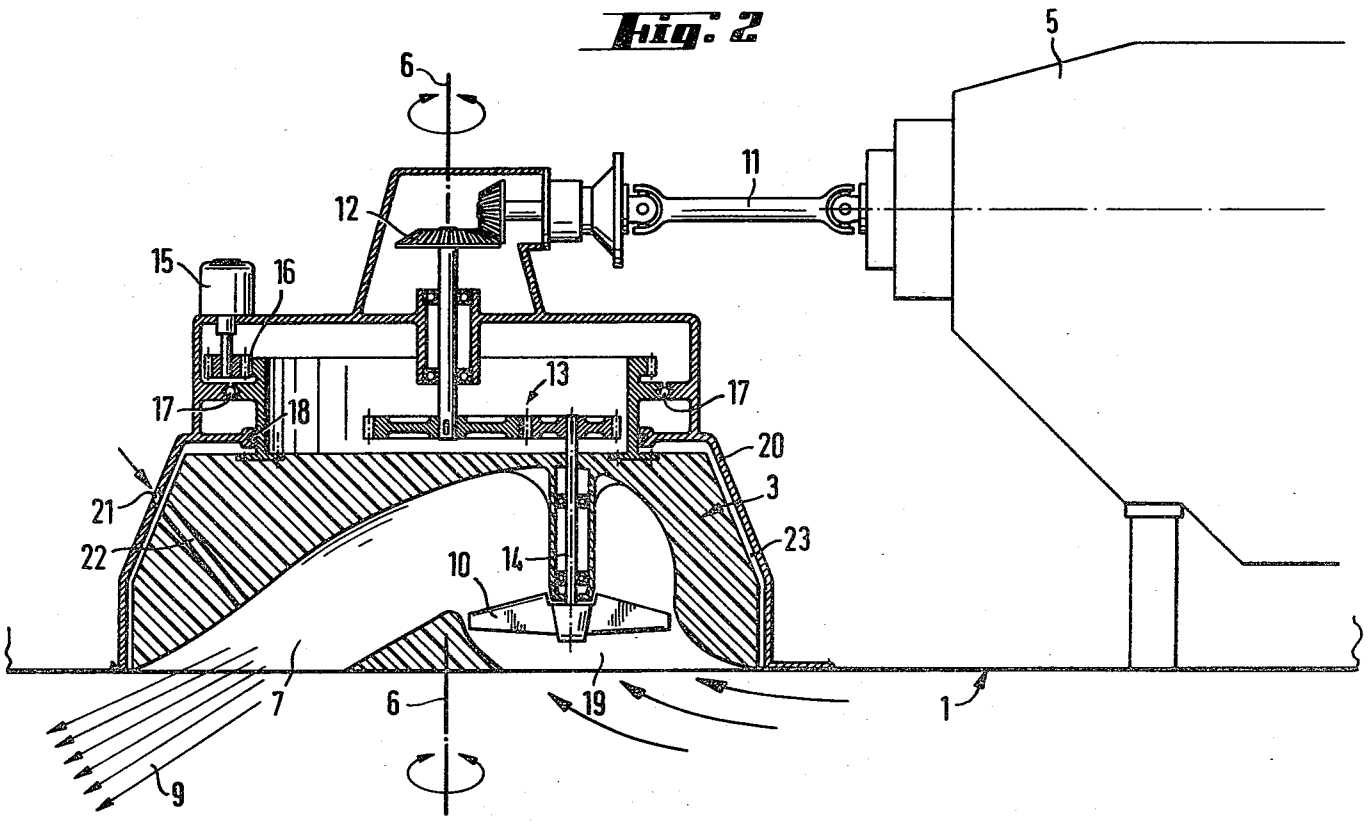
FIG. 2 is a schematic cross-sectional view of a water-jet drive mechanism according to the invention.

FIG. 2 illustrates a drive mechanism, in which the propeller pump 10 is arranged, in contrast to FIG. 1, parallel to but eccentrically of the pivot axis 6 of the elbow 3. The propeller pump is driven by the motor 5 through a drive shaft 11, a bevel gear set 12, a spur gear set 13 and a propeller shaft 14, on which the propeller of the propeller pump 10 is mounted. The invention is also usable for embodiments in which the propeller shaft is supported axially with respect to the pivot axis 6. The elbow 3 is pivotally housed within a recess defined by a housing 20 fixed within the watercraft 1. The elbow 3 can be pivoted about the axis 6 by being driven by a second motor 15 (here mounted on the housing 20) through a gear drive 16 or the like. A suitable bearing 17 and seal 18 are provided between the elbow 3 and housing 20. The elements and principles for this are known, and thus parts 15, 16, 17 and 18 are only schematically illustrated.

The propeller pump 10 sucks water in through a suction passage 19 and ejects it through the ejector passage 7 in a desired direction depending on the position of the elbow. In the absence of the invention, the jet flows along the surface of the hull of the ship, as shown at 8 in FIG. 1. To prevent this, an inlet opening 21 is provided in the housing 20 and at least one opening 22 is provided in the elbow. The openings 21 and 22 form at least one passageway through which air can pass from outside the housing 20 into the ejector passage 7. A gap 23 between the housing and the elbow acts as an annular groove, which insures that in every position of the elbow air can pass serially through the openings 21 and 22.

The gap 23 is sealed from the outside on the one side by the water and on the other side by the seal 18. If necessary, several inlet openings, an additional annular groove and additional seals can be provided.

The described air supply takes care that the water jet does not lie against the hull of the ship, but indeed exits at a downward inclination, as at 9 in FIG. 1.

Figure 3:
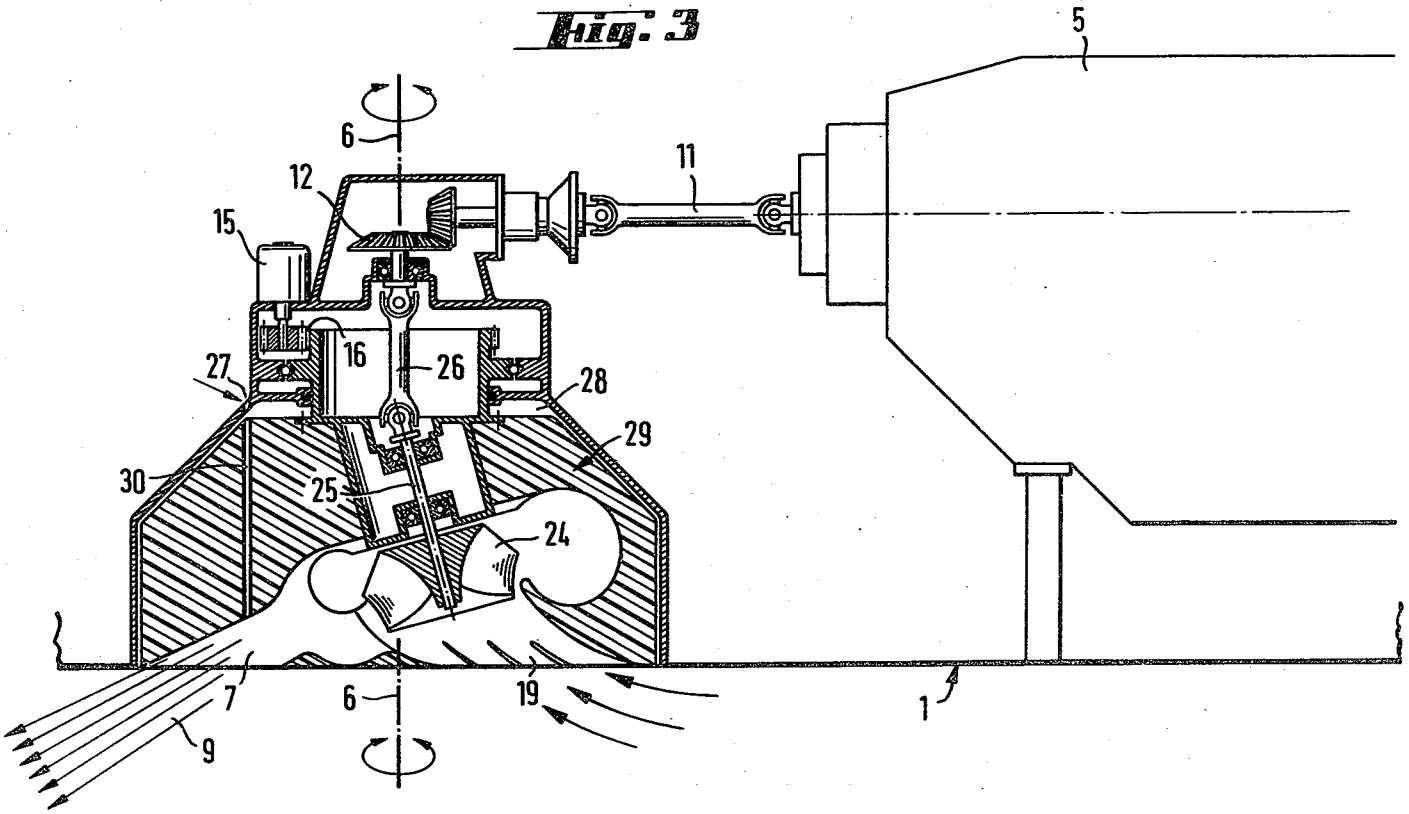
FIG. 3 also is a schematic cross-sectional view of a different exemplary embodiment of the invention.

The exemplary embodiment according to FIG. 3 differs from the one according to FIG. 2 in that the pump shaft 25, on which the impeller of a centrifugal pump 24 is mounted, is supported so as to be inclined to the swivel axis 6. The torque is transmitted through a cardan shaft 26. In place of the cardan shaft, a suitable gear drive, for example a bevel gear set, can be provided.

The FIG. 3 embodiment differs further from that of FIG. 2 in that the inlet opening 27 is provided higher in the housing, so that the air enters an annular chamber 28, which is provided above the elbow 29. From here an opening 30 extends into the ejector passage 7. The annular chamber 28 is sealed off like in FIG. 2. The air supply here too causes the water jet 9 to exit inclined downwardly.

It is also advantageous for several reasons, for example for the noise damping, if the inlet opening, or openings, 21 or 27 is, or are, connected to the exhaust passage of the motor 5. "Motor" in the sense of the invention is any power engine which serves the drive, for example an internal combustion engine, a gas or steam turbine or a steam engine.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A water-jet drive mechanism for propelling a watercraft having a hull on a body of water, comprising a suction passage communicating with said body of water; a downwardly inclined ejector passage communicating with said body of water; pump means communicating with said suction passage and said ejector passage for drawing water in through said suction passage and ejecting it in a downwardly inclined direction through said downwardly inclined ejector passage as a water jet; means for ensuring said water jet continues in said downwardly inclined direction after leaving said ejector passage, including means for supplying a gas to the water flowing through said ejector passage; housing means defining a recess in said hull; an elbow supported in said recess, said suction passage and said ejector passage being provided in said elbow; said means for supplying said gas including a gas inlet through said housing means and a gas passageway in said elbow which communicates with said gas inlet and with said ejector passage and conveys a gas to said ejector passage from said gas inlet in said housing means; said elbow being pivotally supported within said recess for movement about a generally vertical axis; said housing means being separated from said pivotable elbow by an annular space, said gas inlet through said housing means opening into said annular space, said gas passageway through said elbow providing communication from said annular space to said ejector passage; and said housing means and said elbow having cooperating sealing means.

2. Water-jet drive mechanism according to claim 1, wherein said gas is air.

3. A water-jet drive mechanism for propelling a watercraft having a hull on a body of water, comprising an elbow recessed in said hull of said watercraft; a pump supported in said elbow, said elbow including a suction passage through which said pump sucks in water from said body of water and an ejector passage opening downwardly through and inclined at an angle to the bottom of said hull, said pump ejecting a water jet from said ejector passage in a direction inclined downwardly at said angle with respect to the bottom of said hull; means for causing said water jet to continue in said downwardly inclined direction after it leaves said ejector passage, including a gas outlet port opening into said downwardly inclined ejector passage at a location above the bottom of said hull and gas passageway means providing communication through said elbow between said gas outlet port and an inlet port within said hull for feeding a gas into the water flowing through said downwardly inclined ejector passage; a housing fixed within said watercraft and opening downwardly through the bottom of said hull, said elbow being received within said housing and said housing covering the portion of said elbow above the bottom of said hull, the bottom of said elbow being substantially flush with the bottom of said hull in the region adjacent the outlet of said ejector passage, said elbow being supported within said housing for pivotal movement about a substantially vertical axis, said inlet port of said gas passageway means extending through said housing; and said gas passageway means including gas pivot connection means for facilitating passage of gas from said inlet port to said outlet port in all angular positions of said elbow with respect to said housing, said gas pivot connection means including an annular gas space provided between said elbow and said housing and communicating with said inlet port, and a gas passageway extending through said elbow from said annular gas space to said gas outlet port, said gas passageway being pivotable with said elbow.

4. Water-jet drive mechanism according to claim 3, wherein said ejector passage has a top wall sloping downward in the direction of flow, said gas outlet port opens into ejector passage through said downward sloping wall thereof, and said gas outlet port is sufficiently close to the outlet opening of said ejector passage to be opposed to a portion of said ejector passage outlet in a direction substantially diametrically across said ejector passage.

5. Water-jet drive mechanism according to claim 3, wherein said gas passageway means includes said inlet port being in communication with the air outside said housing.

* * * * *